US005115397A

United States Patent [19]

Takahashi et al.

[11] Patent Number: 5,115,397

[45] Date of Patent: May 19, 1992

[54] SURGE-CORRECTED FUEL CONTROL APPARATUS FOR AN INTERNAL COMBUSTION ENGINE

[75] Inventors: Akira Takahashi, Kyoto; Yoshiaki Kanno, Hyogo; Jiro Sumitani, Hyogo; Katsuya Nakamoto, Hyogo; Takeo Sasaki, Hyogo; Masahira Akasu, Hyogo, all of Japan

[73] Assignees: Mitsubishi Jidosha Kogyo K.K.; Mitsubishi Denki K.K., both of Tokyo, Japan

[21] Appl. No.: 547,541

[22] Filed: Jul. 3, 1990

Related U.S. Application Data

[63] Continuation of Ser. No. 886,846, Jul. 18, 1986, abandoned.

[30] Foreign Application Priority Data

Jul. 18, 1985 [JP] Japan ..... 60-158532

[51] Int. Cl.[5] ..... F02D 41/18

[52] U.S. Cl. ..... 364/431.05; 123/494; 123/488; 123/478; 73/118.2

[58] Field of Search ..... 364/431.05, 431.06; 123/478, 488, 489, 494; 73/861.22, 861.23, 118.2

[56] References Cited

U.S. PATENT DOCUMENTS

| | | | |
|---|---|---|---|
| 4,280,189 | 7/1981 | Takato et al. | 364/431.12 |
| 4,334,426 | 6/1982 | Kita et al. | 73/861.22 X |
| 4,409,929 | 10/1983 | Sasaki et al. | 123/494 X |
| 4,424,568 | 1/1984 | Nishimura et al. | 364/431.07 |
| 4,433,663 | 2/1984 | Asayama | 73/861.22 X |
| 4,454,845 | 6/1984 | Takase | 123/478 |
| 4,546,748 | 10/1985 | Karino et al. | 123/492 X |
| 4,580,221 | 4/1986 | Isobe et al. | 364/431.05 |
| 4,606,318 | 8/1986 | Tsuchida et al. | 123/494 X |
| 4,643,152 | 2/1987 | Yamato | 364/431.05 X |
| 4,683,539 | 6/1987 | Kanno et al. | 364/431.05 |
| 4,705,001 | 11/1987 | Danno et al. | 123/417 |
| 4,721,087 | 1/1988 | Kanno et al. | 123/494 |

FOREIGN PATENT DOCUMENTS

| | | |
|---|---|---|
| 54-58119 | 5/1979 | Japan . |
| 60-60025 | 4/1985 | Japan . |
| 2007392 | 5/1979 | United Kingdom . |
| 2103367 | 2/1983 | United Kingdom . |

*Primary Examiner*—Parshotam S. Lall
*Assistant Examiner*—V. N. Trans
*Attorney, Agent, or Firm*—Sughrue, Mion, Zinn, Macpeak & Seas

[57] ABSTRACT

A fuel injection control apparatus for an internal combustion engine in which the air taken into the intake manifold by a Karman vortex detector. However, the amount of fuel injected is based on a calculated intake volume. The calculated intake volume for a time interval is a weighted sum of the measured volume and the calculated intake volume of the previous period. This overaging amounts for surge storage in the intake manifold and other input paths.

4 Claims, 8 Drawing Sheets

SURGE-CORRECTED FUEL CONTROL APPARATUS FOR AN INTERNAL COMBUSTION ENGINE

This is a continuation of application Ser. No. 886,846, filed Jul. 18, 1986, now abandoned.

BACKGROUND OF THE INVENTION

1. Field of the Invention

The present invention relates to a fuel control apparatus for an internal combustion engine, in which the quantity of air taken into the internal combustion engine is detected by utilizing a Karman vortex stream phenomenon and the quantity of fuel supplied to the internal combustion engine is controlled on the basis of this detection output.

2. Background Art

When a cylindrical body is set in a flow of fluid, the flow is separated from the surface of the cylindrical body in the vicinity of the opposite sides of the body so as to alternately generate vortexes on the opposite sides. The vortexes grow to form a vortex stream which flows downstream. This vortex stream is called a Karman vortex stream and such a phenomenon as described above is widely known. As disclosed in, for example, Japanese Patent Publication No. 13428/76, there have been proposed a variety of apparatuses in which the number of generated Karman vortexes is counted so as to detect the velocity of flow of the flow rate of the fluid generating the Karman vortices based upon the fact that the number of generated Karman vortexes is closely dependent on the velocity flow of the fluid.

In the case where such a Karman swirling flow rate detection apparatus as described above is provided upstream of a throttle valve of an internal combustion engine, that is, in an air intake path, it measures the quantity of air sucked into the internal combustion engine. However, there is a problem that the Karman swirling flow rate detection apparatus may measure the quantity of air taken into and occupying the air intake path between the throttle valve and the engine in addition to the quantity of suction air taken into the combustion chambers when the throttle valve is rapidly opened. As a result, the thus measured value exceeds the quantity of air actually sucked into the internal combustion engine. Therefore, if the quantity of fuel supplied supply to the internal combustion engine is controlled on the basis of the thus measured value, the fuel-air ratio disadvantageously becomes overrich. In order to eliminate this disadvantage, there has been proposed such a technique that the quantity of suction air is limited so as not to exceed a predetermined value. In this proposal, however, there has been such a problem that it is impossible to properly control the quantity of supplied fuel.

SUMMARY OF THE INVENTION

An object of the present invention is therefore to solve the foregoing problems.

In particular, an object of the present invention is to provide a fuel control apparatus for an internal combustion engine, in which an air-fuel ratio can be suitably controlled even in a period of transitions in the quantity of suction air.

In the fuel control apparatus for an internal combustion engine, according to the present invention, the quantity of fuel supplied to the internal combustion engine is controlled on the basis of a value AN(n) obtained through an expression $AN(n)=K_1\times AN(n-1)+K_2\times AN(t)$, where AN(t) represents a result obtained from the Karman vortex detector, and AN(n−1) and AN(n) represent calculated values of respective quantities of air sucked into the internal combustion engine at the (n−1)th and the n-th detection of the predetermined crank angle respectively.

In the fuel control apparatus for an internal combustion engine according to the present invention, the correction defined by the expression $AN(n)=K_1\times AN(n-1)+K_2\times AN(t)$ is performed to obtain a value which approximates the quantity of air actually sucked in the internal combustion engine, and the quantity of fuel supplied to the internal combustion engine is controlled by the control means on the basis of this value AN(n).

DETAILED DESCRIPTION OF THE PREFERRED EMBODIMENTS

Prior to the description of an embodiment of the fuel control apparatus in an internal combustion engine according to the present invention, a model will be described of a suction system in an internal combustion engine in order to explain the principle of the present invention. Also, an arrangement of the fuel control apparatus in an internal combustion engine according to the present invention will be described.

Figure 3:
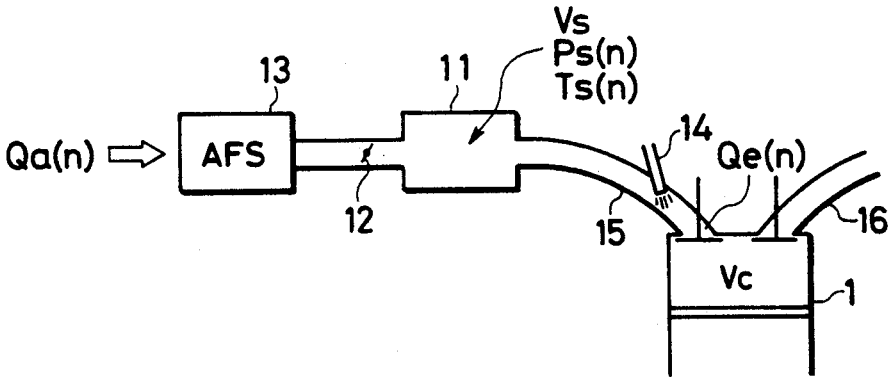
FIG. 3 is a block diagram showing a model of a suction system for an internal combustion engine for explaining the present invention.

FIG. 3 shows a model of a suction system for an internal combustion engine. In the drawing, an internal combustion engine 1 has a volume of $V_c$ per stroke. In this model, air is sucked into the internal combustion engine 1 through an air flow sensor (hereinafter, abbreviated to "AFS") 13 which is a Karman swirling flow rate detection apparatus, a throttle valve 12, a surge tank 11, and a suction pipe 15. On the other hand, fuel is supplied to the internal combustion engine 1 through an injector 14. In the drawings, $V_s$ represents a volume of the path from the throttle valve 12 to the internal combustion engine 1.

Figure 4:
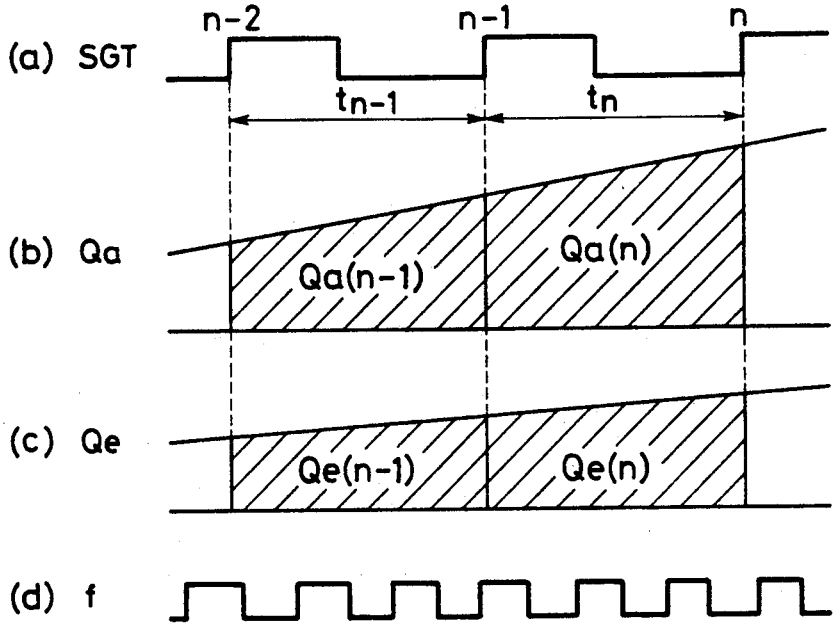
FIG. 4 is a diagram showing the relationship between the quantity of suction air and the crank angle of the internal combustion engine of FIG. 3.

FIG. 4 shows the relationship between the quantity of suction air and a predetermined crank angle in the internal combustion engine 1. In part (a) of FIG. 4 is shown a predetermined crank angle (hereinafter, referred to as an "SGT") of the internal combustion engine 1. In part (b) is shown a quantity of air passed through the AFS 13. Part (c) shows a quantity of air sucked in the internal combustion engine 1 and part (d) shows a series of output pulses produced from the AFS 13. The closer the pulses, the higher the air flow rate. In FIG. 4, $t_{n-1}$ represents a period between the respective leading edges of the (n−2)nd and the (n−1)st output pulses of the SGT; $t_n$ is a period between the respective leading edges of the (n−1)st and the n-th output pulses of the same series of SGT pulses; $Q_a(n-1)$ and $Q_a(n)$ are the quantities of sucked air passed through the AFS 13 in the periods $t_{n-1}$ and $t_n$ respectively; and $Q_e(n-1)$ and $Q_e(n)$ are the quantities of air sucked into the internal combustion engine 1 in the periods $t_{n-1}$ and $t_n$, respectively. Further, the mean pressures in the surge tank 11 in the periods $t_{n-1}$ and $t_n$ are represented by $P_s(n-1)$ and $P_s(n)$. The mean temperature of sucked air in the surge tank 11 in the periods $t_{n-1}$ and tn are represented by $T_s(n-1)$ and $T_s(n)$, respectively. Here, for example, the quantity of sucked air $Q_a(n-1)$ corresponds to the number of output pulses produced from the AFS 13 in the period $t_{n-1}$. Assuming that the mean intake air temperature $T_s(n-1)$ approximately equals $T_s(n)$ because the rate of change in sucked air temperature is small, and that the charging efficiency of the internal combustion engine 1 is fixed, the following expressions (1) and (2) are established:

$$P_s(n-1)\cdot V_c = Q_e(n-1)\cdot R\cdot T_s(n) \quad (1)$$

$$P_s(n)\cdot V_c = Q_e(n)\cdot R\cdot T_s(n) \quad (2)$$

where R is a constant.

If the quantity of air present in the surge tank 11 and the suction pipe 15 in the period $t_n$ is represented by $Q_a(n)$, the value of $\Delta Q_a(n)$ is expressed by the following equation (3):

$$\begin{aligned}\Delta Q_a(n) &= Q_a(n) - Q_e(n) \\ &= V_s\cdot\frac{1}{R\cdot T_s}(P_s(n) - P_s(n-1))\end{aligned} \quad (3)$$

Then, the following expression (4) is obtained from the expressions (1), (2), and (3):

$$Q_e(n) = \frac{1}{1+V_c/V_s}\cdot Q_e(n-1) + \left(1 - \frac{1}{1+V_c/V_s}\right)\cdot Q_a(n) \quad (4)$$

Therefore, the quantity of air sucked into the internal combustion engine 1 in the period $t_n$ can be calculated by the expression (4) on the basis of the air quantity $Q_a(n)$ passed through the AFS 13.

Here, assuming that $V_c$=0.5 liter and $V_s$=2.5 liter, the expression (4) becomes as follows:

$$Q_e(n) = 0.83\times Q_e(n-1) + 0.17\times Q_a(n) \quad (5)$$

Figure 5:
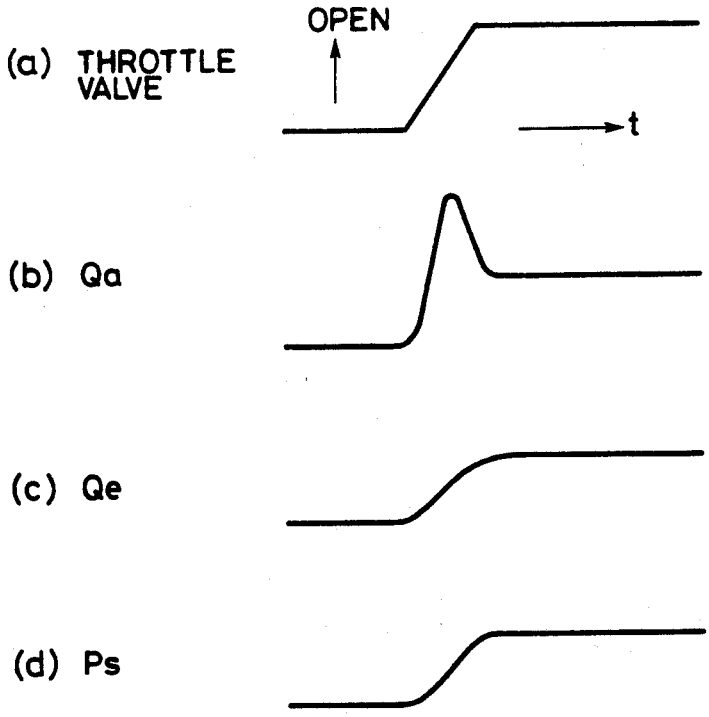
FIG. 5 is a waveform diagram showing a change in quantity of suction air in a period of transition in the same internal combustion engine.

FIG. 5 shows a state of the model of the suction system in the case where the throttle valve 12 is opened. Part (a) in FIG. 5 shows an opening of the throttle valve 12. Part (b) shows the quantity of sucked air passed through the AFS 13. It is noted that the quantity is overshot. Part (c) shows the quantity of air sucked into the internal combustion engine 1, the quantity having been corrected through the expression (4). Part (d) shows the pressure $P_s$ in the surge tank 11.

According to the present invention, a value which approximates the quantity of air actually sucked into the internal combustion engine 1 is calculated by the correction shown in the expression (4) so that the air-fuel ratio is properly controlled even in a period of transition of the air-fuel ratio.

Figure 1:
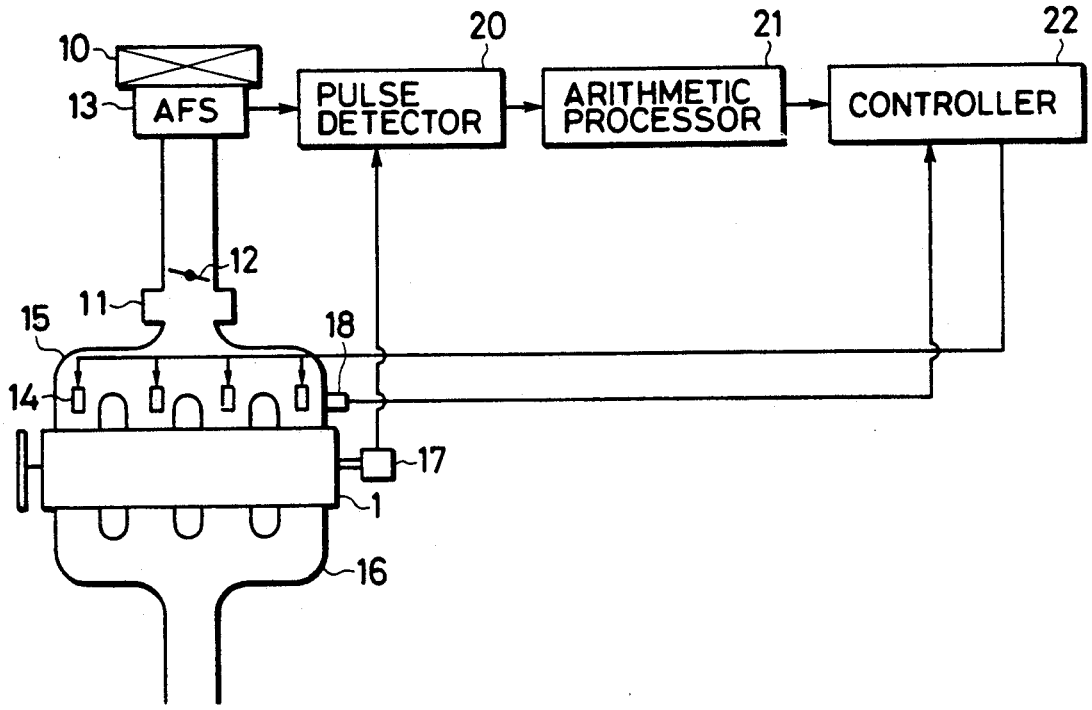
FIG. 1 is a block diagram showing the fuel control apparatus for an internal combustion engine, according to the present invention.

FIG. 1 shows an arrangement of the fuel control apparatus in an internal combustion engine, according to the present invention. In the drawing, an air cleaner 10 is located upstream from an AFS 13. The AFS 13 produces a series of pulses f as shown in the part (d) of FIG. 4, corresponding to the quantity of air sucked into an internal combustion engine 1. A crank angle sensor 17 produces series of pulses SGT as shown in part (a) of FIG. 4 in accordance with a rotational speed of the engine 1. The interval between the respective leading edges of adjacent pulses is defined to be, for example, 180 degrees of the crank angle. A pulse detector 20 calculates the number of output pulses from the AFS 13 within a predetermined crank angle of the internal combustion engine 1 on the basis of the respective outputs of the AFS 13 and the crank angle sensor 17. An arithmetic processor 21 performs calculations according to expression (5) on the basis of an output of the pulse detector 20 so as to obtain the number of output pulses of the AFS 13 corresponding to the quantity of air which is considered to be sucked into the internal combustion engine 1. Further, a controller 22 controls the driving time of an injector 14 corresponding to the quantity of air sucked in the internal combustion engine 1 on the basis of the respective outputs of the arithmetic processor 21 and a water temperature sensor 18 (for example, a thermistor or the like) for detecting a temperature of the cooling water of the internal combustion engine 1. Thereby, the controller 22 controls the quantity of fuel supplied to the internal combustion engine 1.

Figure 2:
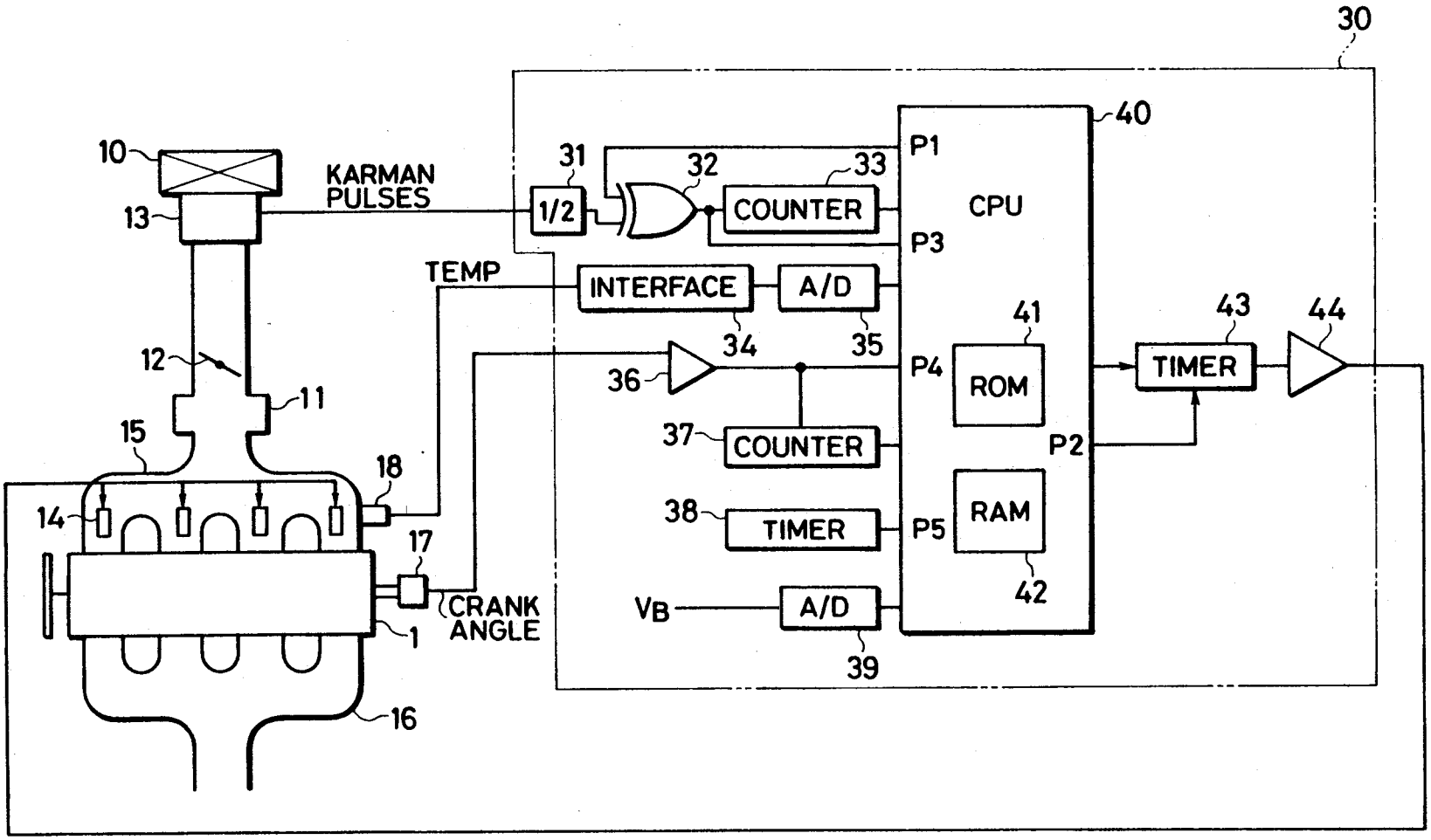
FIG. 2 is a block diagram showing a specific embodiment of the fuel control apparatus for the same internal combustion engine.

FIG. 2 shows a specific embodiment of the fuel control apparatus in an internal combustion engine, according to the present invention. In FIG. 2, the elements 1–18, being the same in structure as those correspondingly referred to in FIG. 1, their explanation will be omitted. A control apparatus 30 is arranged to receive respective output signals from an AFS 13, a water temperature sensor 18, and a crank angle sensor 17 to thereby control four injectors 14 provided for corresponding cylinders of an internal combustion engine 1. The control apparatus 30 corresponds to the combination of the pulse detector 20, the arithmetic processor 21, and the controller 22 of FIG. 1. The control apparatus 30 is realized by a microcomputer 40 provided with built-in ROM 41 and RAM 42. A two-fold frequency divider 31 is connected to the output of the AFS 13. An exclusive-OR gate 32 has its two input terminals connected to an output of the twofold frequency divider 31 and an output $P_1$ of the microcomputer 40. The output terminal of the exclusive-OR gate 32 is connected to an counter 33 as well as to an input $P_3$ of the microcomputer 40. An interface 34 is connected between the water temperature sensor 18 and an A/D converter 35. A waveform shaping circuit 36 has an input for receiving an output of the crank angle sensor 17 and an output connected to an interruption input $P_4$ of the microcomputer 40 as well as to a counter 37. Further, a timer 38 is connected to an interruption input $P_5$ of the microcomputer 40. An A/D converter 40, in which a voltage of a battery (not shown) is converted from analog to digital form, applies a digital voltage to the microcomputer 40. An output timer 43 provided between the microcomputer 40 and a driver 44 has an output connected to the injector 14.

Now, the operation of the thus arranged fuel control apparatus will be described for an internal combustion engine. The frequency of an output of the AFS 13 is divided by the two-fold frequency divider 31 and the thus obtained output is applied to the counter 33 through the exclusive-OR gate 32 controlled by the microcomputer 40. The counter 33 measures a period between the respective trailing edges of adjacent output pulses from the exclusive-OR gate 32. The microcomputer 40 receives the trailing edges of the output pulses of the exclusive-OR gate 32 at its interruption input $P_3$ and performs interruption processing every period of the output of the AFS 13 or every time the period is divided by 2 to thereby measure the period of the counter 33. An output of the water temperature sensor 18 is converted into a voltage by the interface 34 and the thus obtained voltage is converted into a digital value by the A/D converter 35 every given time, the digital value being input into the microcomputer 40. An output of the crank angle sensor 17 is applied, through the waveform shaping circuit 36, to the interruption input $P_4$ of the microcomputer 40 and to the counter 37. In the microcomputer 40, interruption processing is performed at every leading edge of the output pulse of the crank angle sensor 17, to thereby detect a period between the respective leading edges of the adjacent pulses of the crank angle sensor 17 on the basis of an output of the counter 37. The timer 38 applies an interruption signal to the interruption input $P_5$ of the microcomputer 40 at regular time intervals. A voltage of the battery (not shown) is A/D converted by the A/D converter 39 so that data as to the battery voltage is input into the microcomputer 40 at regular time intervals. The output timer 43 is preset by the microcomputer 40 so as to produce a pulse of predetermined pulsewidth in response to a trigger signal applied from an output port P2 of the microcomputer 40 so that the injector 14 is driven through the driver 44 by the output of the timer 43.

Referring to flowcharts of FIGS. 6, 8, and 9, the operation of the microcomputer 40 will be described in more detail.

Figure 6:
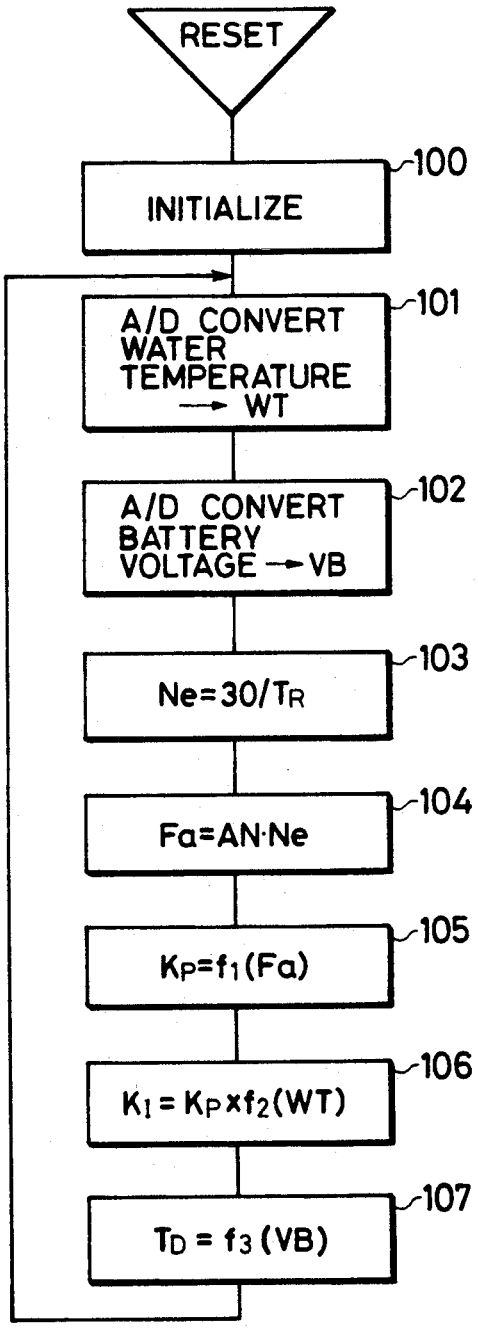
FIGS. 6, 8, and 9 are flowcharts for explaining the operation of the embodiment of the fuel control apparatus for the internal combustion engine, according to the present invention.
Figure 7A:
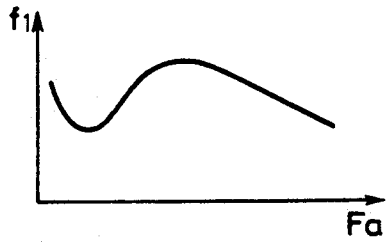
FIG. 7A is a diagram showing the relationship between the reference driving time conversion coefficient and the AFS output frequency of the fuel control apparatus in the same internal combustion engine.
Figure 7B:
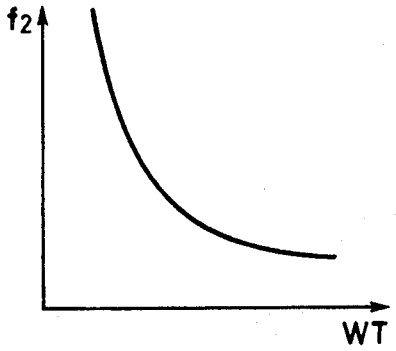
FIG. 7B illustrates a correction of the reference time driving time conversion coefficient of FIG. 7A dependent upon the engine temperature.
Figure 7D:
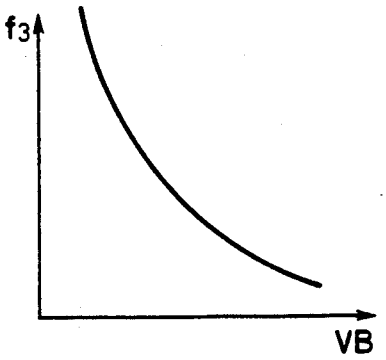
FIG. 7D illustrates how the injector flow can be corrected by the waste time extrapolations of FIG. 7C.
Figure 7C:
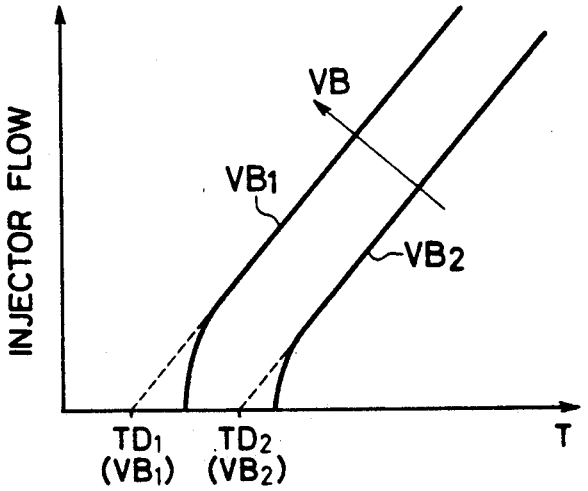
FIG. 7C illustrates the dependence of injector flow upon pulse width and battery voltage.

FIG. 6 shows a main program of the microcomputer 40. First, in the step 100, upon application of a reset signal to the microcomputer 40, the RAM 42 in the microcomputer 40, the input/output ports, etc., are initialized. In step 101, an output of the water temperature sensor 18 is A/D converted so as to be stored in the RAM 42 as data WT. In step 102, a battery voltage is A/D converted so as to be also stored in the RAM 42 as data VB. In step 103, a calculation is carried out to obtain 30/TR on the basis of a period TR of the crank angle sensor 17 which will be described later, to thereby obtain the rotational speed Ne. In step 104, calculation is carried out to obtain the value of AN·Ne on the basis of a load data AN (which will be described later) and the rotational number Ne to thereby obtain the value of an output frequency Fa of the AFS 13. In step 105, a reference driving time conversion coefficient $K_P$ is calculated on the basis of the output frequency Fa as well as a function $f_1$ set with respect to the output frequency Fa as shown in FIG. 7A. In step 106, the conversion coefficient $K_P$ is corrected on the basis of the water temperature data WT and stored in the RAM 42 as a driving time conversion coefficient $K_I$. The water temperature correction follows the functional dependence shown in FIG. 7B. In step 107, mapping is carried out on a data table $f_3$ stored in the ROM 41 in advance to calculate waste time $T_D$ on the basis of the battery voltage VB and the waste time $T_D$ is stored in the RAM 42. The basis of this correction is described as follows. Injector flow characteristic are generally linear with respect to the pulse width T, as shown in FIG. 7C. However, the flow characteristics are non-linear at small pulse widths. The extrapolation of the linear portions cross the zero flow axis at a pulse width defined to be the waste time $T_D$. The waste time $T_D$ thus provides a linearized dependence of the injector flow. The waste time $T_D$ varies inversely with the battery voltage as shown by the functional dependence of $f_3$ in FIG. 7D. The information produced in steps 106 and 107 are in the nature of corrections and is not completely necessary. After the processing of the step 107 has been carried out, the procedure is repeated from the step 101.

Figure 8:
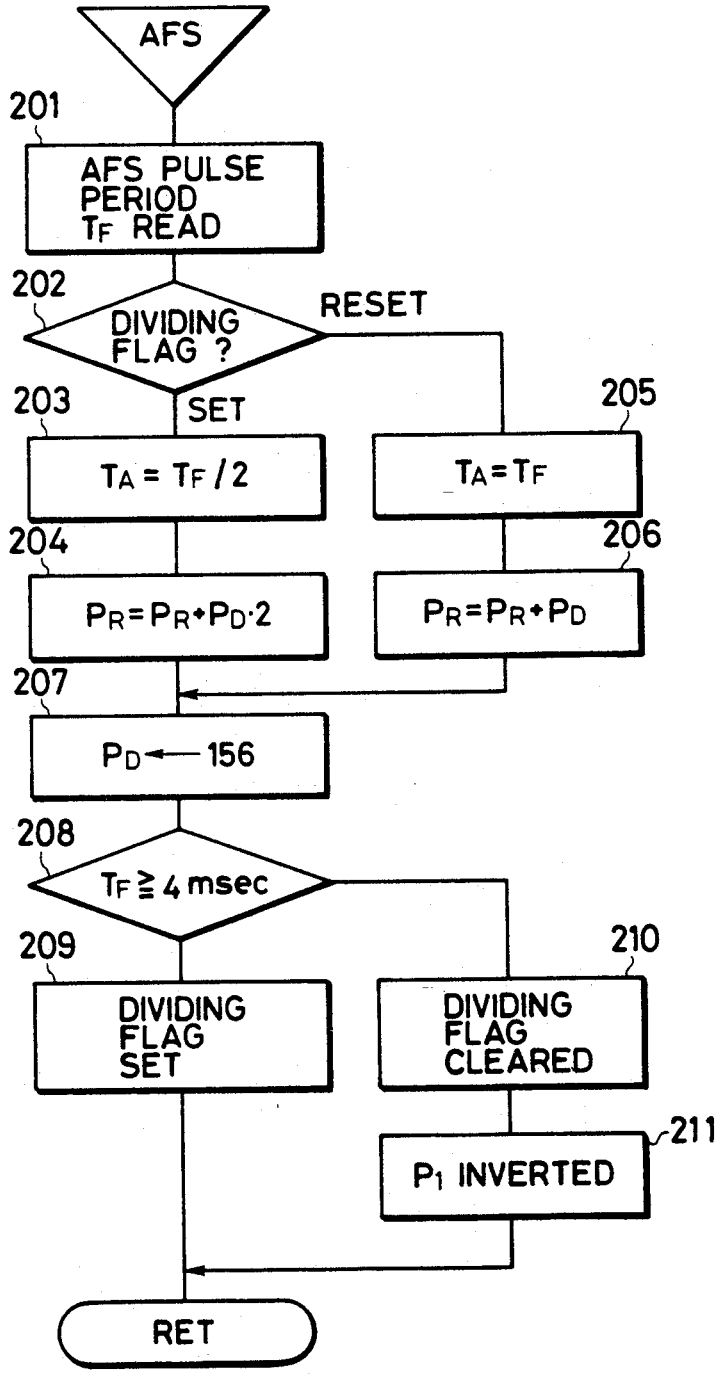

FIG. 8 shows interruption processing carried out in response to an input to the interruption input P3, that is, an output signal produced from the AFS 13. In step 201, an output $T_F$ of the counter 33 is detected and the counter 33 is cleared. This output $T_F$ represents the period between the respective leading edges of the adjacent output pulses of the exclusive-OR gate 32. If a test in step 202 determines that a dividing flag is set in the RAM 42, in step 203, the period $T_F$ is divided in half and stored in the RAM 42 as an output pulse period $T_A$ of the AFS 13. Next, in the step 204, twice the value of the remainder pulse data $P_D$ is added to an integrated pulse data $P_R$ to obtain a new integrated pulse data $P_R$.

The remainder pulse data $P_D$ is a software controlled value generally corresponding to pulses from the AFS 13. However, to perform finer processing than that allowed by the discrete pulsed outputs of the AFS 13, the remainder pulse data $P_D$ is 156 times larger than the corresponding number of pulses of the AFS 13. This multiplication factor is arbitrary. This integrated pulse data $P_R$ corresponds to an integrated value of the number of pulses produced by the AFS 13 between the respective leading edges of adjacent pulses produced from the crank angle sensor 17 and is increased by 156 times (just as for $P_D$) for one pulse from the AFS 13 to satisfactorily perform processing. The multiplication for PR is in fact performed upon $P_D$. If the test in step 202 determines that the driving flag is reset, the operation is shifted to step 205. In step 205, the period $T_F$ is stored in the RAM 42 as the output pulse period $T_A$, and in step 206, the remainder pulse data $P_D$ is added to the integrated pulse data $P_R$. In step 207, the remainder pulse data $P_D$ is set to be 156 (the multiplying factor, so that this is a setting for one real pulse). In step 208, a test is made as to whether $T_F$ is greater than 4 milliseconds in the case where the driving flag is set. If the answer is yes, the operation is shifted to step 210. If, on the other hand, the answer is no, operation is shifted to step 209.

In step 209, the dividing flag is set. In step 210, the driving flag is cleared, and in step 211, the polarity of a signal at the output Pl is inverted. Therefore, a set signal is applied to the interruption output P3 at the timing of ½ division of the output pulse of the AFS 13 when the processing of the step 209 is carried out. On the other hand, when the processing of step 210 is effected, a clear signal is applied to the interruption output P3 at every output pulse of the AFS 13. Upon the completion of the processing of the step 209 or 211, the interruption processing is completed.

Figure 9:
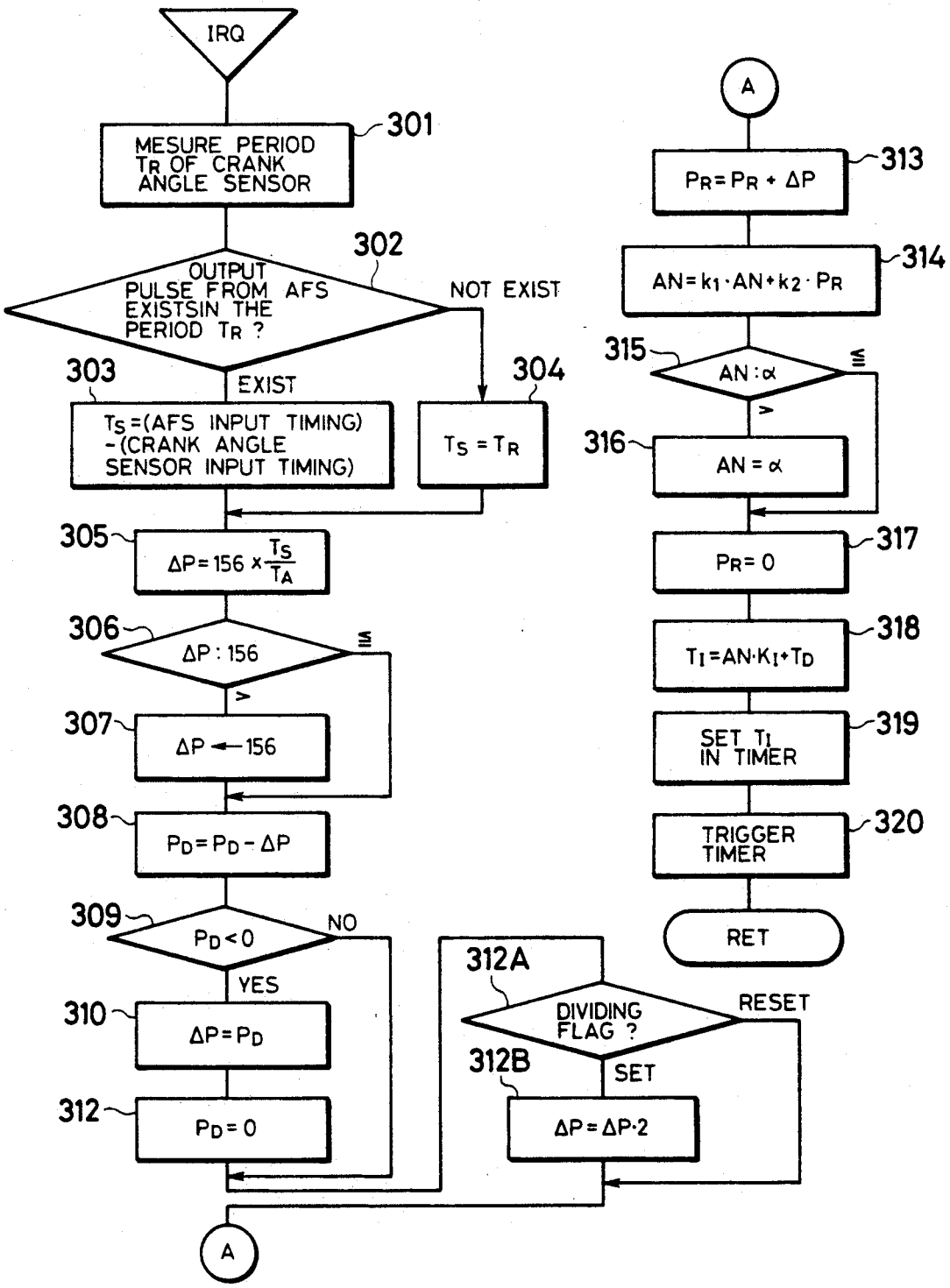

FIG. 9 shows the interruption processing when an interruption signal is generated at the interruption input P4 of the microcomputer 40 in response to the output of the crank angle sensor 17. In step 301, a period between the respective leading edges of adjacent output pulses of the crank angle sensor 17 is read out of the counter 37 and stored in the RAM 42 as the period $T_R$ and the counter 37 is cleared. If a test at step 302 determines that the output pulse from the AFS 13 exists in the period $T_R$, a time difference between the immediately preceding timing $t_{01}$ of the output pulse from the AFS 13 and the present interruption timing $t_{02}$ of the output pulse from the crank angle sensor 17 is calculated, that is, the time difference $\Delta t = t_{02} - t_{01}$, and the resultant value is set as a period $T_S$ in the step 303. If the test in step 302 proves that the output pulse from the AFS 13 does not exist in the period $T_R$, the period $T_R$ is set as the period $T_S$ in the step 304. Next, in step 305, the time difference $\Delta t$ is converted into an output pulse data $\Delta P$ of the AFS 13 through the calculation of $\Delta P = 156 T_S / I_A$. That is, the pulse data $\Delta P$ is calculated on the assumption that the preceding output pulse period of the AFS 13 is equal to the succeeding output pulse period of the AFS 13. If a test in step 306 proves that the pulse data $\Delta P$ is not larger than 156, the operation is shifted to step 308. If the test in step 306 proved that the pulse data $\Delta P$ is larger than 156, on the other hand, the pulse data $\Delta P$ is clipped to 156 in the step 307.

In step 308, the pulse data $\Delta P$ is subtracted from the preceding remainder pulse data $P_D$ to thereby obtain the succeeding remainder pulse data $P_D$. If a test in step 309 proves that the remainder pulse data is not smaller than zero, the operation is shifted to step 313. If the judgment in the step 309 proves that the remainder pulse data is smaller than zero, on the other hand, the pulse data $\Delta P$ is made to be equal to the remainder pulse data $P_D$ in the step 310, because the calculated value of the pulse data P exceeds the output pulse of the AFS 13 by too much. In step 312, the remainder pulse data $P_D$ is set to zero. If a test in step 312A proves that a dividing flag is set, the pulse data $\Delta P$ is doubled in step 312B. In step 313, the pulse data $\Delta P$ is added to the integrated pulse data $P_R$ and the sum is regarded as a new integrated pulse data $P_R$ which corresponds to the number of pulses which might be produced in the present period between the respective leading edges of adjacent output pulses of the crank angle sensor 17.

In step 314, the calculation corresponding to the expression (5) is carried out. That is, the calculation of $(K_1 \cdot AN + K_2 \cdot P_R)$ is carried out on the basis of the load data AN calculated till the preceding leading edge of the output pulse of the crank angle sensor 17 and the integrated pulse data $P_R$ and the result of this calculation is set as a present or new load data AN. If a test in step 315 proves that this load data AN is larger than a predetermined value $\alpha$, the data AN is clipped to the value $\alpha$ in the step 316 so that the load data AN does not exceed an actual value by too much even in the state of full gate opening of the internal combustion engine 1. In step 317, the integrated pulse data $P_R$ is cleared. In step 318, a driving time data $T_I$ is calculated through an expression $$T_I = AN \cdot K_I + T_D$$

on the basis of the load data AN, the driving time conversion coefficient $K_I$, and the waste time $T_D$. The driving time data $T_I$ is set in the timer 43 in step 319, and the timer 43 is triggered in step 320 to thereby drive the four injectors 14 simultaneously with each other on the basis of the data $T_I$. Thus, the interruption processing is completed. As mentioned above, the full correction by $K_I$ and $T_D$ is not required.

Figure 10:
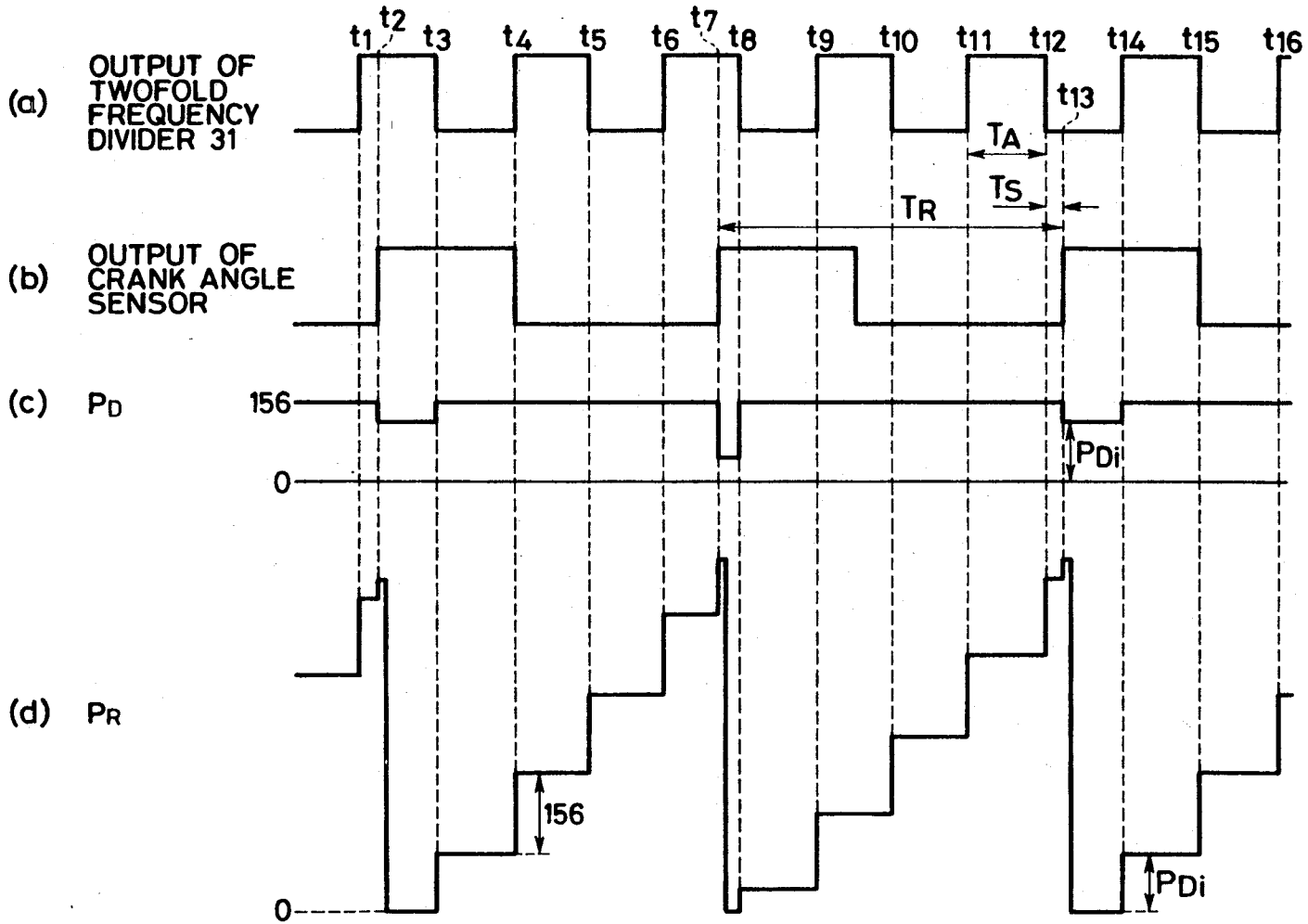
FIG. 10 is a timing chart showing timings in the flowcharts shown in FIGS. 8 and 9.

FIG. 10 shows the timings when the driving flag is cleared in the processing of FIGS. 6, 8, and 9. In FIG. 10, trace (a) shows the output of the two-fold frequency divider 31. Trace (b) is the output of the crank angle sensor 17. Trace (c) shows the remainder pulse data $P_D$ which is set to 156 at every leading and trailing edge of the pulse form the twofold frequency divider 31 (that is, at every leading edge of the output pulse of the AFS 13) and changed into a calculated result, for example, $P_{D1} = P_D - 156 \cdot T_S / T_A$, at every leading edge of the pulse from the crank angle sensor 17 (this operation corresponds to the processing of the steps 305–312). Trace (d) shows the variation in integrated pulse data $P_R$, that is, a process where the remainder pulse data $P_D$ is integrated at every leading or trailing edge of the output pulse from the twofold frequency divider 31.

Although the number of output pulses produced from the AFS 13 in a period between the respective leading edges of adjacent output pulses of the crank angle sensor 17 is counted in the foregoing embodiment, the number of output pulses in a period between the respective trailing edges of adjacent output pulses of the same may be, alternatively, counted, or the number of AFS output pulses in several periods of the crank angle sensor 17 may be counted.

Although the number of output pulses from AFS 13 is counted in the foregoing embodiment, the product of the number of AFS output pulses and a constant corresponding to the output frequency of the AFS 13 may be, alternatively, counted.

Also in the case where the crank angle is detected by using an ignition signal from the internal combustion engine 1 in place of the crank angle sensor 17, the same effect as that of the foregoing embodiment is obtained.

Thus, in the foregoing embodiment, the property of response in control operations can be improved because the fuel calculation is carried out in synchronism with the leading edge of the output pulse of the crank angle sensor 17. Further, since such a filtering procedure, as shown in the expression (5), is performed, the integrated pulse data $P_R$ is obtained on average while there is scatter to some extent. Therefore the rate of change in injector driving time is made small.

As described above, the fuel control apparatus for an internal combustion engine, according to the present invention is arranged such that filter processing as defined by the expression: $AN(n) = K_1 \cdot AN(n-1) + K_2 \cdot AN(t)$ is performed on the basis of the quantity of suction air detected within a predetermined crank angle to thereby control the quantity of fuel supplied to the internal combustion engine. Therefore, it is possible to control the quantity of fuel supply in the internal combustion engine in accordance with the quantity of air actually sucked in internal combustion engine and to properly control the air-fuel ratio even in a period of transition. Further, it is possible to use the thus calculated load data as data for other control, for example, as load information for map data of spark advance values for electronic advancing control. Thus, there is a further effect that it is possible to properly control the value of spark advancing in a period of transition.

What is claimed is:

1. A fuel control apparatus for an internal combustion engine having a throttle valve and a combustion chamber, comprising:

an air flow rate sensor disposed upstream of said throttle valve for generating a first output signal in proportion to a quantity of air sucked into said internal combustion engine;

a crank angle sensor for generating a second output signal every predetermined crank angle of said internal combustion engine;

detection means for calculating an air quantity $Q_a$ passed through said air flow rate sensor based on said first output signal in every section which is divided by said second output signal;

operation means for sequentially calculating a value of $Q_e$ on the basis of an expression $$Q_e(n)=K\times Q_e(n-1)+(1-K)\times Q_a(n)$$

wherein $Q_e$ represents an air quantity sucked in said combustion chamber of said internal combustion engine, $Q_e$ (n) represents $Q_e$ in the n-th section, $Q_e(n-1)$ represents $Q_e$ in the (n−1)th section, and $Q_a(n)$ represents $Q_a$ in the n-th section, and $K=1/(1+V_c/V_s)$; where $V_c$ represents a volume of air sucked into the internal combustion engine per stroke, and $V_s$ represents a volume of the path from the throttle valve to the internal combustion engine; and control means for controlling a quantity of fuel to be supplied to said internal combustion engine based on said $Q_e$ obtained by said operation means.

2. A fuel control apparatus as claimed in claim 1, further comprising an injector having a valve the opening time of which is electrically adjusted to set the quantity of fuel to be supplied to said internal combustion engine, said injector being disposed near said combustion chamber, wherein said control means comprises drive pulse width setting means for setting a drive pulse width information for said injector based on said $Q_e$, and injector driving means for opening said valve of said injector based on said drive pulse information, and processing means for operating said detection means, said operation means, said drive pulse width setting means, and said injector driving means, using said second output signal forming end edges of said sections as a trigger, sequentially, in the stated order.

3. A fuel control apparatus as claimed in claim 1, wherein said first output signal comprises a discrete signal having a frequency in proportion to said quantity of air sucked into said internal combustion engine, and said detection means comprises counter means for counting the number of generations of said discrete signal during each of said sections, and $Q_a$ setting means for setting said $Q_a$ based on the result of counting by said counter means.

4. A fuel control apparatus as claimed in claim 3, wherein said detection means further comprises correction means for correcting the result of counting by said counter means based on an interval between said second output signal and said discrete signal adjacent to each other and an interval of generation of said discrete signal, and wherein said $Q_a$ setting means sets said $Q_a$ based on the result of counting which has been corrected by said correction means.

* * * * *